United States Patent [19]

Patil et al.

[11] Patent Number: 4,513,033

[45] Date of Patent: Apr. 23, 1985

[54] DIFFERENTIALLY COATED GALVANIZED STEEL STRIP AND METHOD AND APPARATUS FOR PRODUCING SAME

[75] Inventors: Ram S. Patil, Munster; Donald F. Johnson, Hammond; John T. Quasney, East Chicago, all of Ind.

[73] Assignee: Inland Steel Company, Chicago, Ill.

[21] Appl. No.: 572,386

[22] Filed: Jan. 20, 1984

[51] Int. Cl.[3] ..... C23C 1/02

[52] U.S. Cl. ..... 427/349; 427/383.9; 427/374.6; 427/374.3; 427/374.4; 427/433

[58] Field of Search ..... 427/349, 383.9, 374.6, 427/433, 374.3, 374.4

[56] References Cited

U.S. PATENT DOCUMENTS

| | | | |
|---|---|---|---|
| 3,148,080 | 5/1960 | Mayhew . | |
| 3,782,909 | 1/1974 | Cleary | 427/349 |
| 4,120,997 | 10/1978 | Franks | 427/349 |
| 4,171,392 | 10/1979 | Sievert | 427/349 |
| 4,171,394 | 10/1979 | Patil et al. . | |

*Primary Examiner*—Sam Silverberg

*Attorney, Agent, or Firm*—Marshall, O'Toole, Gerstein, Murray & Bicknell

[57] ABSTRACT

A differentially coated, galvanized steel strip is produced by hot dip coating both sides of a steel strip and adjusting the weight of coating metal on opposite sides of the strip to produce a light coated side and a heavy coated side. The strip is then precooled to fully solidify the heavy coated side following which the galvanized strip is subjected to a treating step in which simultaneously the light coated side is heated and the heavy coated side is cooled. This fully transforms the light coated side to iron-zinc alloy throughout while only partially transforming an inner layer on the heavy coated side to iron-zinc alloy. The outer layer on the heavy coated side consists entirely of coating metal, and there are no intermittent bleed-throughs of iron-zinc alloy to the outer surface of the heavy coated side.

16 Claims, 2 Drawing Figures

DIFFERENTIALLY COATED GALVANIZED STEEL STRIP AND METHOD AND APPARATUS FOR PRODUCING SAME

BACKGROUND OF THE INVENTION

The present invention relates generally to hot dip coated galvanized steel strip and more particularly to a differentially coated, galvanized steel strip wherein one of two opposite strip sides has a relatively light coat composed of iron-zinc alloy and the other strip side has a relatively heavy coat at least the outer part of which consists essentially of zinc. The present invention also relates particularly to methods and apparatuses for producing such a differentially coated, galvanized steel strip.

A differentially coated, galvanized steel strip of the general type described in the preceding paragraph, and a method and apparatus for producing such a galvanized steel strip is described in Patil et al., U.S. Pat. No. 4,171,394 issued Oct. 16, 1979, and entitled "Process of Hot-dip Galvanizing and Alloying". The disclosure of said Patil et al. patent is incorporated herein by reference.

A differentially coated, galvanized steel strip of the general type described in said Patil et al. patent is produced by passing a continuous steel strip through a bath of molten coating metal consisting essentially of zinc to coat both sides of the strip with the molten coating metal. Immediately upon withdrawal of the coated metal strip from the bath of molten coating metal, the weight of the molten coating metal on opposite sides of the strip is adjusted by impingement against opposite sides of the strip of jets of gas or steam. The jets on respective opposite sides of the strip are adjusted to provide one strip side with a relatively light coat of the coating metal and the other strip side with a relatively heavy coat of the coating metal. Typically, the weight of the coating metal on the light coated side is in the range 0.05–0.25 oz./ft.$^2$ (0.015–0.075 kg/m$^2$), and the weight of the coating metal on the heavy coated side is in the range 0.35–1.0 oz./ft.$^2$ (0.105–0.30 kg/m$^2$).

Immediately following the weight adjusting step, the strip is passed through a treating zone wherein simultaneously the light coated strip side undergoes heating and the heavy coated strip side undergoes cooling. As a result, the coating metal on the light coated side is transformed to iron-zinc alloy throughout. It is desired, as a result of the treating step, that the coating metal on the heavy coated side be only partially transformed to iron-zinc alloy, and that the outer part of the coating on the heavy coated side consists essentially of zinc. In a method in accordance with the Patil et al. patent, the heavy coated side is at least partially molten at the time the simultaneous heating and cooling step is performed.

In a typical commercial product employing the subject matter of the Patil et al. patent, the weight of the coating metal on the heavy coated side is about 0.50 oz./ft.$^2$ (0.15 kg/m$^2$). In such a product, the iron-zinc alloy on the heavy coated side constitutes an inner layer which ranges from 30 to 50% of the coating thickness on that side. Occasionally, however, as a result of the simultaneous heating and cooling step, in some spots the iron-zinc alloy may extend all the way through to the outer surface on the heavy coated side causing a defect known as "bleed-through". These bleed-throughs occur intermittently along the outer surface of the heavy coated strip side.

In cross-section, a bleed-through resembles the vertical cross-section of a mushroom. Bleed-throughs are undesirable because the iron-zinc alloy in the bleed-through area at the strip's outer surface tends to powder when the galvanized steel strip is subjected to a stamping operation, and this is undesirable. Although the light coated side of the strip consists entirely of iron-zinc alloy throughout, that coating is relatively so thin that it can undergo a stamping operation without powdering. The fully alloyed light coated side is readily paintable.

Galvanized steel strip with bleed-through on the heavy coated side is not acceptable to those who fabricate the galvanized steel strip into products, and such a strip is not saleable. A typical customer for differentially coated galvanized steel strip is a stamping shop making parts for the automotive industry.

Recently there has been a demand, particularly from the automotive industry, for a differentially coated, galvanized steel strip in which the heavy coated side has a thinner coating, e.g., a weight substantially less than 0.50 oz./ft.$^2$ (0.15 kg/m$^2$), typically in the range 0.25–0.45 oz./ft.$^2$ (0.075–0.135 kg/m$^2$). A thinner coating on the heavy coated side makes the strip more weldable. However, the thinner the coating on the heavy coated side, the more likely there is to be a bleed-through when the differentially coated strip is subjected to a simultaneous heating and cooling treatment of the type described in the Patil et al. patent.

When the heavy coated side has a coating weight of 0.50 oz./ft.$^2$ (0.15 kg/m$^2$), a strip with a bleed-through occurs only occasionally, and the strip rejection rate for this defect is about 3–4%. When the coating on the heavy coated side has a weight substantially less than 0.50 oz./ft.$^2$ (0.15 kg/m$^2$), it is virtually impossible to prevent bleed-throughs when employing a process in accordance with the Patil et al. patent, and the iron-zinc alloy may constitute 100% of the coating thickness on the heavy coated side.

SUMMARY OF THE INVENTION

In accordance with the present invention, the heavy coated strip side has a coating weight substantially less than 0.50 oz./ft.$^2$ (0.15 kg/m$^2$), but intermittent bleed-throughs of iron-zinc alloy at the outer surface of the heavy coated side of the differentially coated, galvanized steel strip are prevented. This is accomplished by precooling the heavy coated side of the strip between the weight adjusting step and the simultaneous heating and cooling step. The precooling step substantially fully solidifies the molten coating metal on the heavy coated side before the start of the simultaneous heating and cooling step.

The weight adjusting step which precedes the precooling step provides a coating metal thickness on the heavy coated side of the strip which, absent the precooling step, is thick enough to be at least partially molten at the start of the simultaneous heating and cooling step but not thick enough to avoid intermittent bleed-throughs as a result of the simultaneous heating and cooling step.

Iron diffuses in zinc less rapidly when the zinc is solid than when the zinc is molten. Because the precooling step fully solidifies the coating metal on the heavy coated side, there is reduced diffusion of iron in the coating on the heavy coated side during the simultaneous heating and cooling step, compared to the diffusion which would occur if the coating on the heavy coated side was not solidified before the start of the simultaneous heating and cooling step. Because of the reduced diffusion, bleed-through is prevented.

The precooling step is accomplished by impinging a fluid cooling medium against the heavy coated strip side. This fluid-cooling medium is preferably steam but may also comprise air, nitrogen, or inert gases.

When the heavy coated side is impinged with a fluid-cooling medium such as steam, during the precooling step, the impinging cooling medium causes waves or "sag lines" on the solidified coating metal surface. Such minor surface irregularities are undesirable because they "print through" on the reverse side of the galvanized steel strip during stamping. However, during the simultaneous heating and cooling treatment, following precooling, there is superficial melting of a heavy coated side having a thickness in accordance with the present invention, there is relatively rapid solidification of the heavy coated side following the heating and cooling step, and the sag lines or other minor surface irregularities are eliminated.

On a differentially coated, galvanized steel strip produced in accordance with the present invention, there are no sag lines, the spangle boundaries are flat (i.e., level with the surface of the coating on the heavy coated side) and the outer surface on the heavy coated strip side is relatively smooth compared to the heavy coated side on a differentially coated strip in accordance with prior art procedures. Because that surface is so smooth, it is unnecessary to skin roll the strip as heavy as was necessary with a less smooth surface. Because the strip is subjected to less skin rolling, it is more ductile and has better formability.

Other features and advantages are inherent in the subject matter claimed and disclosed or will become apparent to those skilled in the art from the following detailed description in conjunction with the accompanying diagrammatic drawings.

DETAILED DESCRIPTION

Figures 1, 2:
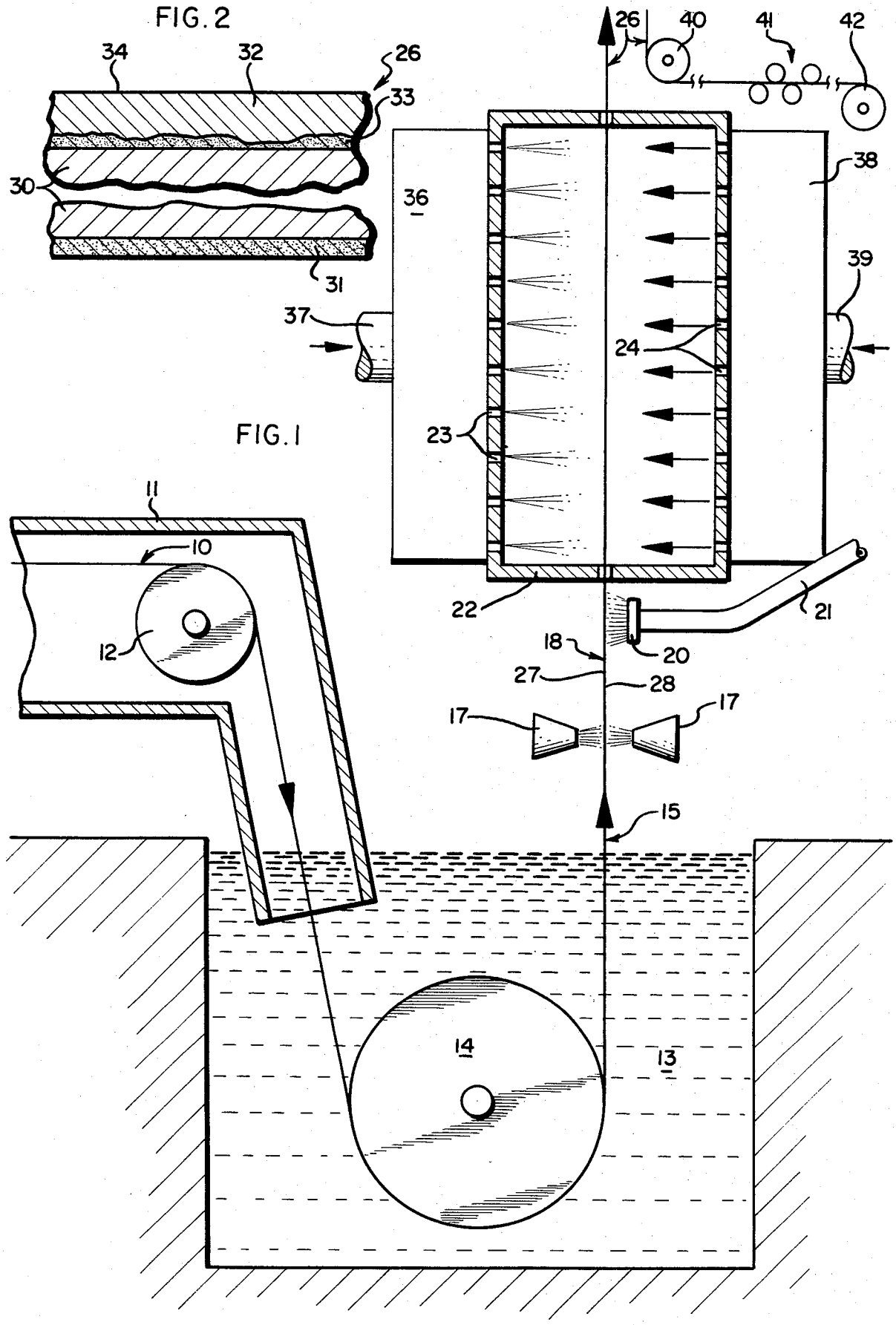
FIG. 1 is a diagrammatic view, partially in section, illustrating a method and apparatus in accordance with an embodiment of the present invention.
FIG. 2 is an enlarged, fragmentary, sectional view illustrating a differentially coated, galvanized steel strip in accordance with an embodiment of the present invention.

Referring initially to FIG. 1 there is illustrated an embodiment of a method and apparatus for producing a differentially coated, galvanized steel strip in accordance with the present invention. Indicated generally at 10 is an uncoated steel strip having a composition conventionally utilized for a continuous, hot-dip galvanizing process, such as the conventional Sendzimir-type process. The strip is moved in the direction of the arrows along a processing path illustrated in FIG. 1, employing conventional equipment for moving the strip.

In the course of moving along this path, strip 10 passes over a turn-down roller 12 located within a hood 11 containing a reducing atmosphere. Hood 11 extends into a bath 13 of molten coating metal consisting essentially of zinc and having a bath temperature in the range 850°–880° F. (454°–471° C.), preferably 865° F. (463° C.). Strip 10 has been preheated and enters bath 13 at essentially the same temperature as the bath. Bath 13 may contain other elements conventionally employed in galvanizing compositions, and an example thereof is disclosed in the aforementioned Patil et al. U.S. Pat. No. 4,171,394. Preferably, the bath contains 0.14–0.16 wt. % aluminum.

Strip 10 passes around a roller 14 located within bath 13 and then passes upwardly out of the bath as a galvanized strip 15 containing substantially equal weights of coating metal on opposite sides of the strip. Galvanized strip 15 passes upwardly between a pair of steam jet nozzles 17, 17 adjustable to control the weight of coating on opposite sides of strip 15. The galvanized strip is at a temperature typically in the range 850°–880° F. (454°–471° C.). The steam jets from nozzles 17, 17 are at a temperature in the range 300°–350° F. (148°–176° C.), so that the jets partially cool strip 15 as well as control the weight of the metal on opposite sides of the strip.

Conventionally, the steam jets are adjusted to provide one strip side 27 with a relatively light coat of the coating metal and the other strip side 28 with a relatively heavy coat of the coating metal. As a result there is produced a differentially coated, galvanized steel strip indicated generally at 18.

Typically, the coating metal weight on light coated side 27 is in the range 0.05–0.15 oz./ft.$^2$ (0.015–0.045 kg/m$^2$), and the coating metal weight on heavy coated strip side 28 is typically in the range 0.25–0.45 oz./ft.$^2$ (0.075–0.135 kg/m$^2$), in accordance with the present invention. In other words the coating metal thickness on strip side 28 is substantially less than 0.50 oz./ft.$^2$ (0.15 kg/m$^2$). In one embodiment, strip side 28 has a coating thickness less than 0.35 oz./ft.$^2$ (0.105 kg/m$^2$), e.g., 0.32 oz./ft.$^2$ (0.096 kg/m$^2$) minimum.

The coating on side 27 is thin enough so that the coating is fully solidified when strip 18 enters a treating chamber 22 located above weight-controlling nozzles 17, 17. On the other hand, the coating on side 28 is thick enough to be at least partially molten when the strip enters chamber 22, absent a precooling step between nozzles 17, 17 and treating chamber 22. The cooling effect imparted by steam jet nozzles 17, 17 is not enough to fully solidify the coating on side 28.

In treating chamber 22, differentially coated steel strip 18 is subjected to simultaneous heating of light coated strip side 27 and cooling of heavy coated strip side 28. This transforms the coating metal on the light coated side to iron-zinc alloy throughout while desirably only partially transforming the coating metal on strip side 28 to iron-zinc alloy.

The heating operation is performed by a plurality of gas jet nozzles at 23, 23 which provide heating flames directed toward light coated strip side 27, and the galvanized strip is heated thereby to a temperature in the range 860°–930° F. (460°–499° C.) or higher. The determining factor as regards strip temperature is to heat the strip to a temperature which will fully alloy the light coated side. The cooling operation is provided by a plurality of air jet nozzles at 24, 24 directed toward heavy coated strip side 28. The air jets are at ambient temperature, e.g., 60° F. (16° C.).

In chamber 22, the gas jet nozzles at 23, 23 communicate with a manifold 36 into which gas is supplied via a conduit 37. The air jet nozzles at 24,24 communicate with a manifold 38 into which air is supplied via a conduit 39.

When heavy coated strip side 28 has the coating weight described five paragraphs above, there can be a problem with intermittent bleed-throughs of iron-zinc alloy to the surface of strip side 28 as a result of the simultaneous heating and cooling step. To avoid such bleed-throughs, there is provided, in accordance with the present invention, a precooling step between the weight adjusting step and the simultaneous heating and cooling step. This precooling step is performed with one or more banks of steam nozzles 20 connected by a conduit 21 to the same steam source as provides steam to nozzles 17, 17. Steam at a temperature in the range 300°–350° F. (148° C.–176° C.) is directed toward heavy coated strip side 28 to cool strip side 28 and fully solidify the coating metal on that strip side.

As previously noted, strip side 28 is still at least partially molten after passing between weight adjusting nozzles 17, 17. Because the precooling step fully solidifies the relatively heavy coating on strip side 28 before strip 18 enters chamber 22, the diffusion of iron in the heavy coat during the simultaneous heating and cooling step is substantially reduced compared to the diffusion which would occur if the heavy coat were not fully solidified before the start of the simultaneous heating and cooling step.

When the coating metal consists essentially of zinc, it has a melting point typically about 780° F. (416° C.), and the coating metal on the heavy coated side should be cooled to a temperature at least 18° F. (11° C.) below that melting point to fully solidify the coating.

The precooling step not only fully solidifies heavy coated side 28 but probably also light coated side 27. However, during the treating step, because the coating on side 27 is so light, it melts immediately upon subjection to the heating flames in chamber 22, allowing rapid diffusion of iron in the light coating so as to fully alloy the latter. The heavy coated side, however, undergoes only superficial melting during the treating step, and there is insufficient diffusion of iron to fully alloy or cause bleed-throughs in the heavy coated side.

The precooling medium is preferably steam (either wet or dry). Steam is conveniently available at the site of the precooling step because the same fluid medium is utilized at weight-controlling nozzles 17, 17. However, other fluid cooling media may be employed, such as air, nitrogen and inert gases.

Whatever its composition, sufficient fluid cooling medium must be employed to cool the coating metal on heavy coated strip side 28 to a temperature below its melting point and fully solidify the coating. Although only one bank 20 of precooling nozzles is illustrated in FIG. 1, two or more banks may be employed when necessary to cool heavy coated side 28 to the temperature required to obtain a fully solidified coating on side 28. When two or more banks are employed, they are arranged at spaced locations between nozzles 17, 17 and chamber 22.

Steam nozzles 20 should be positioned upstream of chamber 22. The steam nozzles should not be located within substantially closed chamber 22 because of possible corrosion problems.

As noted above, during the precooling step, the jets of fluid cooling medium from nozzles 20 are directed against a coating on strip side 28 which is at least partially molten. This causes minor surface irregularities at the outer surface on strip side 28. These minor surface irregularities are in the form of "sag lines" or waves on the solidified outer surface on heavy coated strip side 28.

When strip 18 enters treating chamber 22, heavy coated strip side 28 is in a fully solidified condition. However, during the simultaneous heating and cooling step in chamber 22, there is superficial melting of the coating metal on the heavy coated strip side at the outer surface thereof. Immediately following the heating and cooling step there is relatively rapid solidification of the heavy coated side, compared to a heavy coated side with a thicker coating deposit in accordance with prior practices. A process in accordance with the present invention smooths out the minor surface irregularities resulting from the precooling step, and it also flattens spangle boundaries so that they are level with the outer surface of the heavy coated strip side. It is desirable to eliminate these minor surface irregularities because they can "print through" on the reverse side of the galvanized steel strip during a subsequent stamping operation performed on that strip.

The differentially coated, galvanized steel strip exiting chamber 22 is indicated at 26. This strip is conventionally subjected to a "skin rolling" step at an in-line skin rolling station 41 downstream of chamber 22, employing conventional skin rolls. Alternatively, skin rolling may be performed out of line, after the strip has been otherwise processed and coiled. When skin rolling is performed out of line, the cooled strip is uncoiled, skin rolled and then recoiled.

For a differentially coated strip produced in accordance with the present invention, the outer surface of the heavy coated strip side is relatively so smooth before skin rolling that, in order to obtain the desired surface texture on the outer surface of the heavy coated strip side, it is not necessary to skin roll so heavily as before in order to obtain that desired surface texture. More specifically, a skin roll producing a deformation substantially below 1%, e.g., in the range 0.5–0.8%, is employed in accordance with the present invention compared to a deformation in the range 1.0–1.4% on differentially coated strip produced in accordance with prior practices. Because deformation is comparatively less when the strip is produced in accordance with the present invention, the strip is comparatively more ductile and has better formability.

Except for (1) the precooling step employing nozzles 20, (2) the adjustment of the weight controlling step to reduce the thickness of the coating on the heavy coated side and (3) the decrease in deformation during skin rolling, all in accordance with the present invention, the process conditions employed herein are essentially the same as those described in Patil et al., U.S. Pat. No. 4,171,394, the disclosure of which has been incorporated herein by reference. Nevertheless, the resulting differentially coated, galvanized steel strip of the present invention has a ductility about 2% higher on a scale of 100% than the same strip not produced with the processing differences described in the preceding sentence. More particularly, where a strip produced in accordance with the processing conditions of said Patil et al. patent would have a typical ductility after skin rolling in the range 40–43%, the same strip produced in accordance with the present invention would have a ductility after skin rolling in the range 42–45%. The figures in the preceding sentence would be representative of an in-line heat treated, drawing quality, aluminum killed steel.

Referring again to FIG. 1, indicated at 40 is a drive roll located between chamber 22 and skin rolling station 41, and located at the downstream end of the processing path is a coiler 42.

The differentially coated, galvanized steel strip produced in accordance with the present invention, is indicated generally at 26 in FIG. 2. Strip 26 comprises a steel substrate 30 having a pair of opposite sides coated with a coating metal consisting essentially of zinc. One of the strip sides has a relatively light coat composed of iron-zinc alloy throughout, and this is indicated at 31 in FIG. 2. The other strip side has a relatively heavy coat, at least the outer part of the heavy coat consisting essentially of zinc indicated at 32 in FIG. 2. Located between zinc outer part 32 and steel substrate 30 is iron-zinc alloy indicated at 33. The thickness of iron-zinc alloy 33 on the heavy coated side of the strip varies, but it is always less than 25% of the thickness of the heavy coat, as a maximum, and the average thickness is about 10%.

As shown in FIG. 2, there are no intermittent iron-zinc alloy bleed-throughs at the outer surface 34 of the heavy coated strip side. The coating weights on the respective light and heavy coated sides are as described above for the present invention. When the heavy coated strip side has a coating no greater than that described for the present invention, the avoidance of intermittent bleed-throughs of iron-zinc alloy at the outer surface 34 on the heavy coated side would be virtually impossible absent the precooling step performed by nozzles 20.

Moreover, in a strip made in accordance with the present invention, the outer surface 34 on the heavy coated side is brighter than on conventionally produced strips, so that on the rare occasion when a bleed-through may occur (e.g., because of some malfunction of the process or apparatus) such a bleed-through can be readily spotted by an operator and appropriate steps can be taken.

A bleed-through is to be distinguished from the average thickness of the iron-zinc alloy layer on the heavy coated side. In conventional differentially coated, galvanized steel strip, the average thickness of the iron-zinc alloy can be substantially less than the full thickness of the metal coating on that side, but a bleed-through may still be present. In a differentially coated, galvanized steel strip produced in accordance with the present invention, the iron-zinc alloy layer on the heavy coated side is less than 25% of the thickness of the coat on that side, as a maximum, with the average thickness being 10%, and there are absolutely no bleed-throughs.

The foregoing detailed description has been given for clearness of understanding only, and no unnecessary limitations should be understood therefrom, as modifications will be obvious to those skilled in the art.

We claim:

1. A method for producing a differentially coated, galvanized steel strip wherein one of two opposite strip sides has a relatively light coat composed of iron-zinc alloy and the other strip side has a relatively heavy coat at least the outer part of which consists essentially of zinc without surface bleed-throughs of iron-zinc alloy, said method comprising the steps of:

passing a steel strip having two opposite sides through a bath of molten coating metal consisting essentially of zinc to coat both sides of the strip with said molten coating metal;

adjusting the weight of said coating metal on opposite sides of the strip to provide one strip side with a relatively light coat of the coating metal and the other strip side with a relatively heavy coat of said coating metal, said heavy coat being at least partially molten;

simultaneously heating said one strip side and cooling said other strip side to transform the coating metal on said one strip side to iron-zinc alloy throughout while only partially transforming the coating metal on the other strip side to iron-zinc alloy;

and preventing intermittent bleed-throughs of iron-zinc alloy on said other strip side by precooling said other strip side between said weight adjusting step and said simultaneous heating and cooling step;

said precooling step comprising substantially fully solidifying the molten coating metal on said other strip side before the start of said simultaneous heating and cooling step.

2. A method as recited in claim 1 and comprising:

reducing, as a result of said solidifying of the heavy coat, the diffusion of iron in said heavy coat during the simultaneous heating and cooling step, compared to the diffusion which would occur if said heavy coat were not solidified before the start of said simultaneous heating and cooling step.

3. A method as recited in claim 1 wherein:

said weight adjusting step comprises providing a coating metal thickness on said other strip side which, absent said precooling step, is thick enough to be at least partially molten at the start of said simultaneous heating and cooling step but not thick enough to avoid said intermittent bleed-throughs as a result of said simultaneous heating and cooling step.

4. A method as recited in claim 3 wherein:

said weight adjusting step provides a coating metal thickness on said other strip side expressed, in terms of coating weight, as substantially less than 0.50 oz./ft.$^2$ (0.15 kg/m$^2$).

5. A method as recited in claim 4 wherein:

said coating weight on said other strip side is in the range 0.25–0.45 oz./ft$^2$ (0.075–0.135 kg/m$^2$).

6. A method as recited in claim 1 wherein:

said weight adjusting step comprises providing a coating metal thickness on said one strip side expressed, in terms of coating weight, as 0.05–0.15 oz./ft.$^2$ (0.015–0.045 kg/m$^2$).

7. A method as recited in claim 1 wherein said precooling step comprises:

impinging a fluid cooling medium against said other strip side.

8. A method as recited in claim 7 wherein said fluid cooling medium is selected from the group consisting of steam, air, nitrogen and inert gases.

9. A method as recited in claim 1 wherein said precooling step comprises:

cooling said coating metal on said other strip side to a temperature below its melting point.

10. A method as recited in claim 9 wherein:

said coating metal on said other strip side is cooled to at least 18° F. (11° C.) below its melting point.

11. A method as recited in claim 9 wherein:

said precooling step produces minor surface irregularities at the outer surface on said other strip side;

and said method comprises smoothing out said minor surface irregularities resulting from said precooling step, without deformation.

12. A method as recited in claim 11 and comprising:

skin rolling said strip after said smoothing step, said strip being deformed substantially less than 1% during said skin rolling step.

13. A method as recited in claim 1 and comprising:

skin rolling said strip after said simultaneous heating and cooling step, said strip being deformed substantially less than 1% during said skin rolling step.

14. A method as recited in claim 13 wherein said skin rolling step comprises:

deforming said strip 0.5–0.8% during skin rolling.

15. A method as recited in claim 11 wherein said smoothing step comprises:

superficially melting said coating metal on said other strip side;

solidifying said coating metal on the other strip side after said simultaneous heating and cooling step;

said weight adjusting step comprising controlling the weight of said coating metal on the other strip side to provide a relatively rapid solidification rate during said solidification step, compared to the solidification rate of a coating which is thick enough to avoid intermittent bleed-throughs absent said precooling step.

16. A method as recited in claim 11 wherein:

said solidified coating metal on the other strip side has spangle boundaries; and said smoothing step flattens said spangle boundaries so that they are level with the other surface of the other strip side.

* * * * *

UNITED STATES PATENT AND TRADEMARK OFFICE

CERTIFICATE OF CORRECTION

PATENT NO. : 4,513,033

DATED : April 23, 1985

INVENTOR(S) : Ram S. Patil, et al.

It is certified that error appears in the above-identified patent and that said Letters Patent are hereby corrected as shown below:

Col. 10, line 14, "other surface" should be

--"outer surface"--

Signed and Sealed this

Tenth Day of September 1985

[SEAL]

*Attest:*

DONALD J. QUIGG

*Attesting Officer* *Acting Commissioner of Patents and Trademarks - Designate*